US007127930B2

(12) United States Patent
Ishii et al.

(10) Patent No.: US 7,127,930 B2
(45) Date of Patent: Oct. 31, 2006

(54) DEVICE AND METHOD FOR PRESS FORMING

(75) Inventors: Ichiro Ishii, Wako (JP); Taizou Kitamura, Wako (JP); Tokiyuki Wakayama, Wako (JP); Koji Yamaguchi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 272 days.

(21) Appl. No.: 10/471,018

(22) PCT Filed: Feb. 15, 2002

(86) PCT No.: PCT/JP02/01319

§ 371 (c)(1),
(2), (4) Date: Apr. 2, 2004

(87) PCT Pub. No.: WO02/072294

PCT Pub. Date: Sep. 19, 2002

(65) Prior Publication Data

US 2004/0154370 A1 Aug. 12, 2004

(30) Foreign Application Priority Data

Mar. 8, 2001 (JP) ..... 2001-65329

(51) Int. Cl.
*B21D 13/02* (2006.01)
*B21D 37/00* (2006.01)
*B21J 13/03* (2006.01)

(52) U.S. Cl. ..... 72/385; 72/382; 72/481.2; 72/482.3

(58) Field of Classification Search ..... 72/382, 72/385, 482.1, 482.3
See application file for complete search history.

(56) References Cited

U.S. PATENT DOCUMENTS 3,123,125 A * 3/1964 Iacey, Jr. ..... 72/385
3,307,387 A * 3/1967 Lacey, Jr. et al. ..... 72/385
3,430,476 A * 3/1969 Duda ..... 72/385
4,295,689 A 10/1981 Licht (Continued)

FOREIGN PATENT DOCUMENTS

JP 55-158836 A 12/1980

(Continued)

*Primary Examiner*—David Jones
(74) *Attorney, Agent, or Firm*—Birch, Stewart, Kolasch & Birch LLP

(57) ABSTRACT

A pressing apparatus includes a lower die (24) fixed to a lower plate (11), and first and second plate (11), and first and second upper die punches (33 and 34) capable of being lifted and lowered along with an upper plate (12). The first upper die punch (33) supported by a spring (49) is capable of being lifted and lowered relative to the second upper die punch (34). The upper plate (12) is lifted and lowered, while intermittently feeding a band-shaped work (W) one pitch by one pitch from the right to the left along an upper surface of the lower die (24), thereby pressing the work (W) to form grooves in the work (W) continuously. When the groove is formed in the work (W) by pressing the work (W) by the second upper die punch (34), the groove formed at the last time by pressing the work (W) by the second upper die punch (34) is retained and positioned between the first upper die punch (33) and the lower die (24). Therefore, the formation of the grove by the second upper die punch (34) can be carried out accurately.

8 Claims, 13 Drawing Sheets

U.S. PATENT DOCUMENTS

| | | | | |
|---|---|---|---|---|
| 4,840,054 | A * | 6/1989 | Sjogren | 72/385 |
| 4,989,440 | A * | 2/1991 | Sjogren | 72/385 |
| 5,014,540 | A * | 5/1991 | Ferrante | 72/482.3 |
| 6,786,828 | B1 * | 9/2004 | Sørensen | 72/482.3 |

FOREIGN PATENT DOCUMENTS

| | | | |
|---|---|---|---|
| JP | 63-238929 | A | 10/1988 |
| JP | 4-162364 | A | 6/1992 |
| JP | 7-88584 | A | 4/1995 |

* cited by examiner

DEVICE AND METHOD FOR PRESS FORMING

This application is the national phase under 35 U.S.C. § 371 of PCT International Application No. PCT/JP02/01319 which has an International filing date of Feb. 15, 2002, which designated the United States of America.

FIELD OF THE INVENTION

The present invention relates to a pressing process for forming a product of a corrugated shape by pressing a band-shaped work supplied in a lengthwise direction to form a large number of grooves sequentially in the work at a predetermined pitch, and to a pressing apparatus capable of being used appropriately for carrying out the pressing process.

BACKGROUND ART

A pressing apparatus for forming a corrugated foil for a foil-type fluid bearing by allowing a band-shaped metal plate to bite into between a pair of gears is described in U.S. Pat. No. 4,295,689. A pressing apparatus is described in Japanese Patent Application Laid-open No. 7-88564, which is designed to press a metal plate into a corrugated shape and bend it by forming a first groove in a lengthwise central portion of the metal plate by a central piece of a lower die and a central piece of an upper die and further forming a pair of second groove on opposite sides of such groove by two sets of the lower and upper die end pieces.

In the apparatus described in U.S. Pat. No. 4,295,689, corrugated plates having various shapes can be formed only by exchanging the gears. However, this pressing apparatus suffers from a problem that it is necessary to fabricate the gears in correspondence to a required shape of a corrugated plate, resulting in an increase in cost. Moreover, the following problem arises: the spring-back of the metal plate is liable to occur, and the dimensional accuracy of the corrugated plate is lower because the corrugated shape is formed only by the meshing of the gears, and the dimensional accuracy of the corrugated shape formed with the working accuracy of the individual tooth of the gear is dispersed.

In the apparatus described in Japanese Patent Application Laid-open No. 7-88564, when the first groove is formed in the lengthwise central portion of the metal plate by the central piece of the lower die and the central piece of the upper die, portions of the metal plate on opposite sides of the central portion are fed into the first groove, but when the second grooves are formed on the opposite sides of the first groove by the lower and upper die end pieces, a portion of the metal portion on the side of the first groove retained by the central pieces of the lower and upper dies cannot be fed into the second groove. Therefore, there is a problem that the spring-back amounts are not regular between the central portion of the metal plate and the portions on the opposite sides thereof, and when the continuous corrugated plate is formed, the working accuracy is lowered.

DISCLOSURE OF THE INVENTION

The present invention has been accomplished with the above circumstances in view, and it is an object of the present invention to provide a pressing process capable of forming a corrugate plate from a band-shaped work with a high accuracy, and a pressing apparatus capable of being used appropriately for carrying out the pressing process.

To achieve the above object, according to a first aspect and feature of the present invention, there is provided a pressing process for forming a product of a corrugated shape by pressing a band-shaped work supplied in a lengthwise direction to form a large number of grooves sequentially at a predetermined pitch, characterized by the repetition of the following steps: a first step of pressing and retaining the groove in the work by a positioning portion, a second step of pressing the positioning portion with the work remaining retained by the positioning portion to form the groove in the work by a pressing portion adjoining the positioning portion, and a third step of feeding the work by the predetermined pitch to move the groove formed by pressing the work by the pressing portion to the positioning portion.

With the above arrangement, when the groove is formed in the work by the pressing portion at the second step, the work is pressed with the groove formed at the last second step being retained and positioned at the positioning portion. Therefore, the displacement of the work can be prevented, whereby the pressing by the pressing portion can be conducted with a good accuracy. Further, the work pressed at the second step is pressed again by the positioning portion and hence, the strain of the work generated due to the spring-back can be eliminated, leading to an enhancement in press-forming accuracy. The groove formed by the pressing portion is retained at the positioning portion and used for the positioning of the work when a new groove is to be formed in the work by the pressing portion at the next second step. Therefore, the working standards of all the grooves formed continuously by the pressing are the same, and a corrugated product of a high accuracy having regular pitches can be formed.

According to a second aspect and feature of the present invention, in addition to the first feature, the operation stroke of the positioning portion is smaller than the operation stroke of the pressing portion.

With the above arrangement, the operation stroke of the positioning portion is smaller than the operation stroke of the pressing portion and hence, the retaining of the work by the positioning portion (the first step) can be conducted prior to the pressing of the work by the pressing portion (the second step), and the pressing of the work for forming the groove can be carried out with the work remaining retained reliably at the positioning portion.

According to a third aspect and feature of the present invention, in addition to the first feature, a cavity is provided below the positioning portion and the pressing portion, so that the work curved into an arcuate shape upon finishing of the pressing can enter into the cavity.

With the above arrangement, the cavity is provided below the positioning portion and the pressing portion and hence, it is possible to prevent the pressed work from being deformed by interference with another member by allowing the work curved into the arcuate shape upon finishing of the pressing to enter into the cavity.

According to a fourth aspect and feature of the present invention, there is provided a pressing apparatus comprising pressing dies in which pressing teeth are detachably fixed in recesses formed in pressing-tooth holders using wedge members, wherein the pressing teeth and the wedge members slidably abut against each other at parting faces parallel to a pressing direction; each of the wedge members has a first inclined surface inclined at an acute angle $\alpha$ with respect to the pressing direction, so that the width is decreased toward the pressing-tooth holder, and the wedge member slidably abuts, at the inclined surface thereof, against a first inner wall surface of the recess; each of the pressing teeth has a second inclined surface inclined at an acute angle β with respect to the pressing direction, so that the width is increased toward the pressing-tooth holder, and each of the pressing teeth slidably abuts, at the second inclined surface, against a second inner wall surface of the recess; the wedge members are pushed toward the pressing teeth by a reaction force Fx in a direction perpendicular to the parting faces received from the first inner wall surfaces of the recesses by the first inclined surfaces of the wedge members by applying a load F1 toward the pressing-tooth holders to the wedge members to bias the latter, and the pressing teeth are fixed in the recesses of the pressing-tooth holders by biasing the pressing teeth toward bottom wall surfaces of the recesses by a reaction force Fy in the pressing direction received from the second inner wall surfaces of the recesses by the second inclined surfaces of the pressing teeth pushed by the wedge members.

With the above arrangement, when the load F1 toward the pressing-tooth holder is applied to the wedge members to bias the wedge members, the wedge members are pushed toward the pressing teeth by the reaction force Fx in the direction perpendicular to the parting faces received from the first inner wall surfaces of the recesses in the pressing-tooth holders by the first inclined surfaces of the wedge members. Therefore, the pressing teeth can be biased toward the bottom wall surfaces of the recesses by the reaction force Fy in the pressing direction received from the second inner wall surfaces of the recesses by the second inclined surfaces of the pressing teeth pushed by the wedge members, whereby the pressing teeth can be fixed firmly in the recesses in the pressing-tooth holders. Moreover, since the wedge members and the pressing teeth are in close contact with the recesses of the pressing-tooth holders, the rigidity of the pressing die is enhanced, and moreover, the positions of the pressing teeth are constant, leading to an enhancement in working accuracy. Further, the reaction force Fx applied from the wedge members to the pressing teeth can be allowed to vanish only by releasing the load F1 applied to the wedge members, whereby the pressing teeth can be demounted easily from the pressing-tooth holders.

According to a fifth aspect and feature of the present invention, in addition to the fourth feature, the pressing tooth of the pressing die and the pressing tooth of the other pressing die slidably abut against each other at slide surfaces parallel to the pressing direction, and the acute angle α and the acute angle β are determined so that an expression, $$fx<\mu(Fp+Fy)+Fx$$

is established among the load F1 biasing the wedge member, the reaction force Fx received from the first inner wall surface of the recess by the first inclined surface of the wedge member, the reaction force Fy received from the second inner wall surface of the recess by the second inclined surface of the pressing tooth, a pressing load Fp, a load fx in the direction perpendicular to the parting faces received by the pressing tooth from the work restrained by the other pressing die, and a coefficient μ of friction between the pressing tooth as well as the wedge member and the bottom wall surface of the recess.

With the above arrangement, the load μ(Fp+Fy)+Fx intended to push the pressing tooth of the pressing die against the pressing tooth of the other pressing die is larger than the load fx intended to move the pressing tooth of the pressing die away from the pressing tooth of the other pressing die. Therefore, both of the pressing teeth are moved away from each other and thus, it is possible to reliably prevent the working accuracy from being lowered.

According to a sixth aspect and feature of the present invention, in addition to the fourth or fifth feature, α=β.

With the above arrangement, the acute angle α which is the inclined angle of the first inclined surface of the wedge member and the acute angle β which is the inclined angle of the second inclined surface of the pressing tooth are set to be equal to each other and hence, it is easy to fabricate the wedge members and the pressing teeth, leading to an enhancement in working accuracy.

According to a seventh aspect and feature of the present invention, in addition to the fourth or fifth feature, α≧β.

With the above arrangement, the reaction force Fy in the pressing direction received by the pressing tooth is decreased and as a result, the fixing force for the pressing tooth is decreased, but the entire width of the pressing tooth required for ensuring the strength can be decreased.

According to an eighth aspect and feature of the present invention, in addition to the fourth or fifth feature, α<β.

With the above arrangement, the entire width of the pressing tooth required for ensuring the strength is increased, but the reaction force Fy in the pressing direction received by the pressing tooth can be increased to increase the fixing force for the pressing tooth.

A lower die 24, a first upper die punch 33 and a second upper die punch in the embodiments correspond to the pressing dies of the present invention.

BRIEF DESCRIPTION OF THE DRAWINGS

FIG. 1 is a side view of the entire arrangement of a pressing apparatus; FIG. 2 is a sectional view taken along a line 2—2 in FIG. 1; FIG. 3 is a sectional view taken along a line 3—3 in FIG. 1; FIG. 4 is a sectional view taken along a line 4—4 in FIG. 1; FIG. 5 is a sectional view taken along a line 5—5 in FIG. 2; FIG. 6 is a view similar to FIG. 5 for explaining the operation; FIG. 7 is a view similar to FIG. 5 for explaining the operation; FIG. 8 is an enlarged view of a portion indicated by 8 in FIG. 7; FIG. 9 is a view showing a completed pressed product in a curved state; FIG. 10 is a diagram for explaining the functions of inclination angles α and β.

FIG. 12 and FIG. 13 show a fourth embodiment of the present invention, wherein FIG. 12 is a perspective view of a heat exchanger; and FIG. 13 is an enlarged sectional view taken along a line 13—13 in FIG. 12.

BEST MODE FOR CARRYING OUT THE INVENTION

Figure 1:
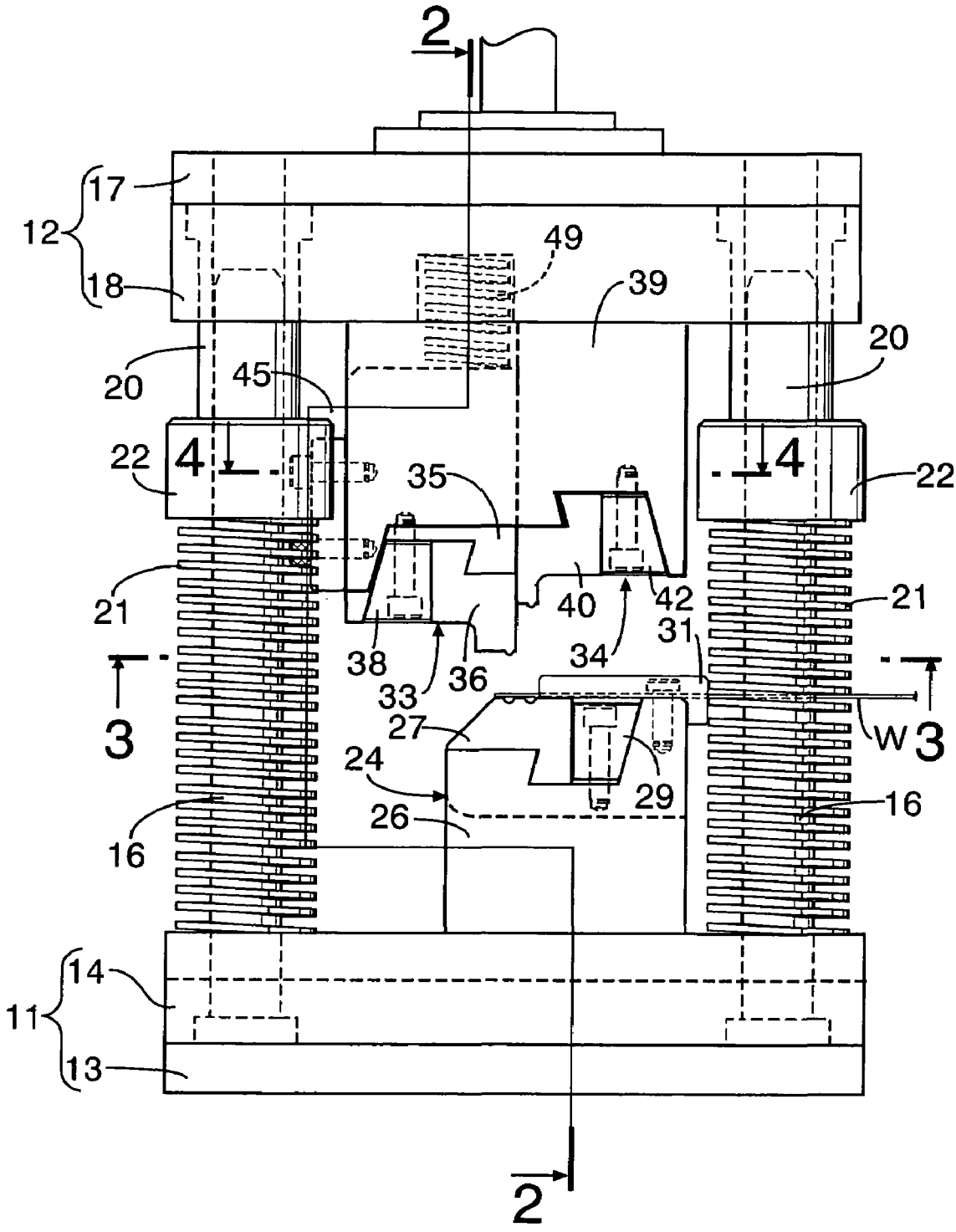
FIGS. 1 to 10 show a first embodiment of the present invention.
Figure 10:
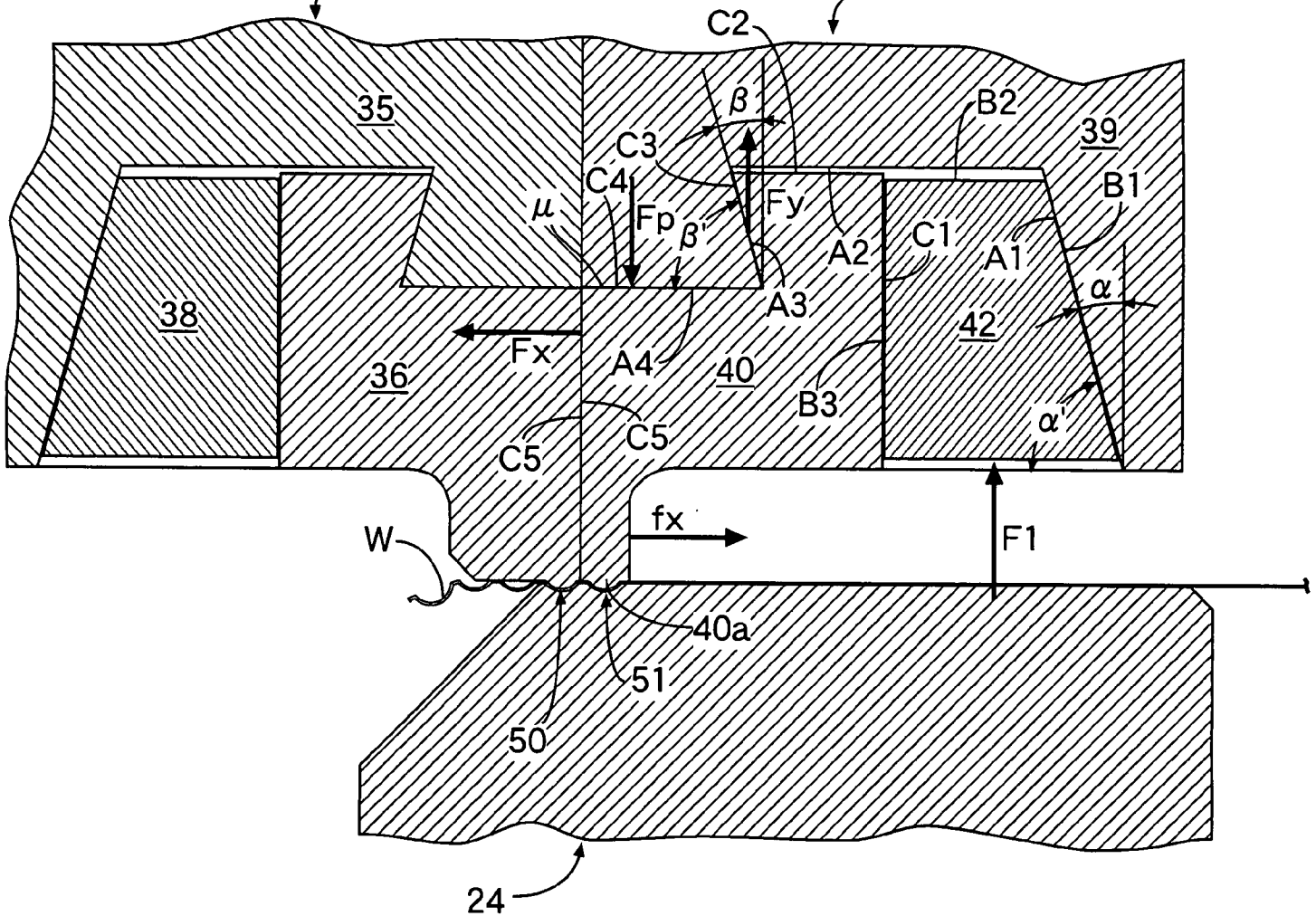

A first embodiment of the present invention will now be described with reference to FIGS. 1 and 10.

As shown in FIGS. 1 to 5, a pressing apparatus according to the present embodiment is intended to form a corrugated plate used as a foil of a foil-type fluid bearing from a band-shaped material into by pressing. The pressing apparatus includes a fixed lower plate 11, and an upper plate 12 disposed above the lower plate 11 and connected to a ram (not shown), so that it is lifted and lowered. The lower plate 11 comprises a lower plate inner 14 superposed on and coupled to an upper surface of a underlying lower plate outer 13 by bolts 15. Four guide rods 16 are mounted to rise at four corners of the lower plate inner 14. The upper plate 12 comprises an upper plate inner 18 superposed on and coupled to a lower surface of an overlying upper plate outer 17 by bolts 19. Upper portions of the four guide rods 16 are slidably fitted into four slide guides 20 fixed at four corners of the upper plate inner 18. Springs 21 fitted over outer peripheries of the guide rods 16 are disposed between spring seats 22 fixed to lower ends of the slide guides 20 and spring seats 14*a* formed on an upper surface of the lower plate inner 14, so that the upper plate 12 is biased upwards by resilient forces of the springs 21.

Figure 2:
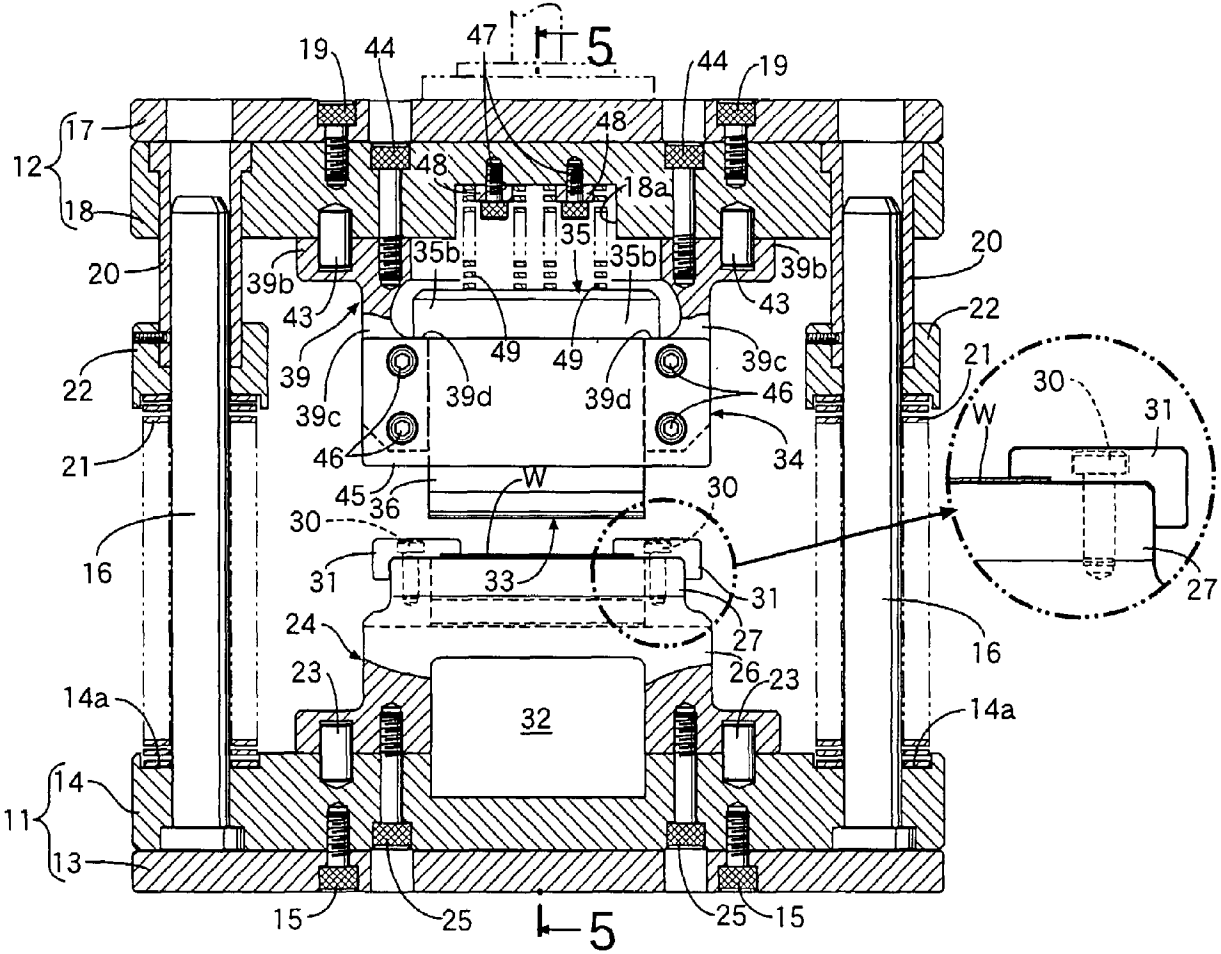
Figure 3:
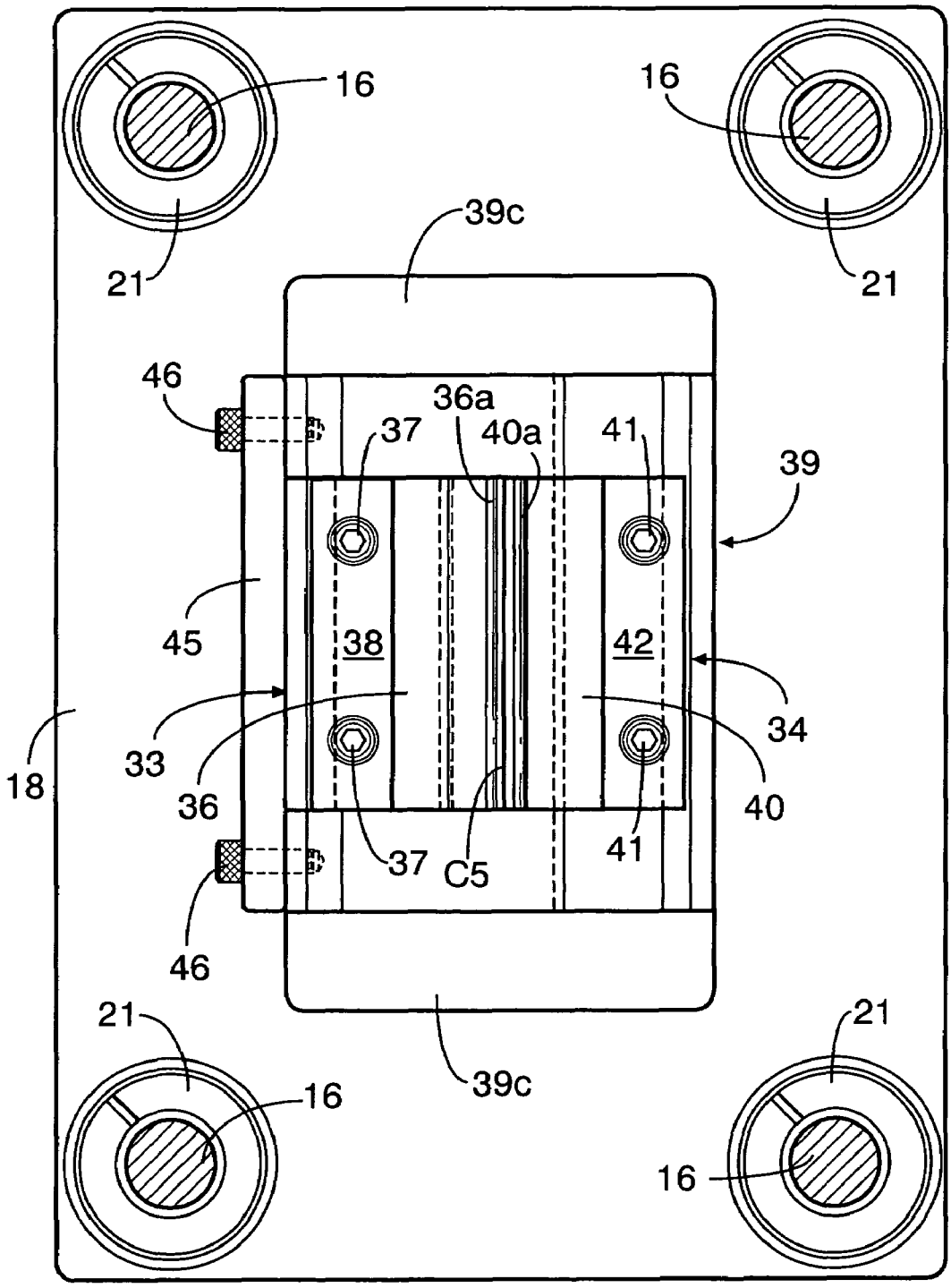
Figure 4:
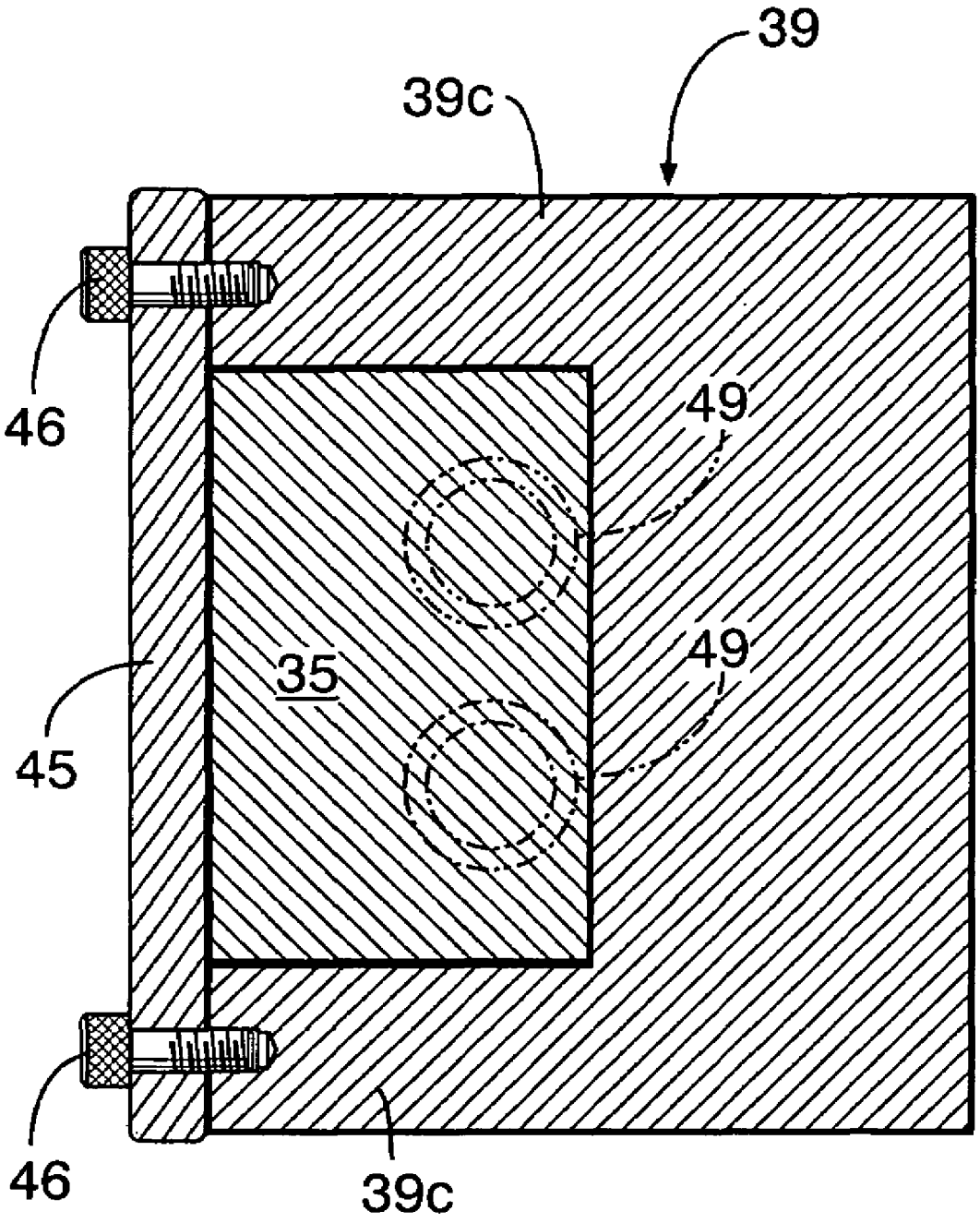
Figure 5:
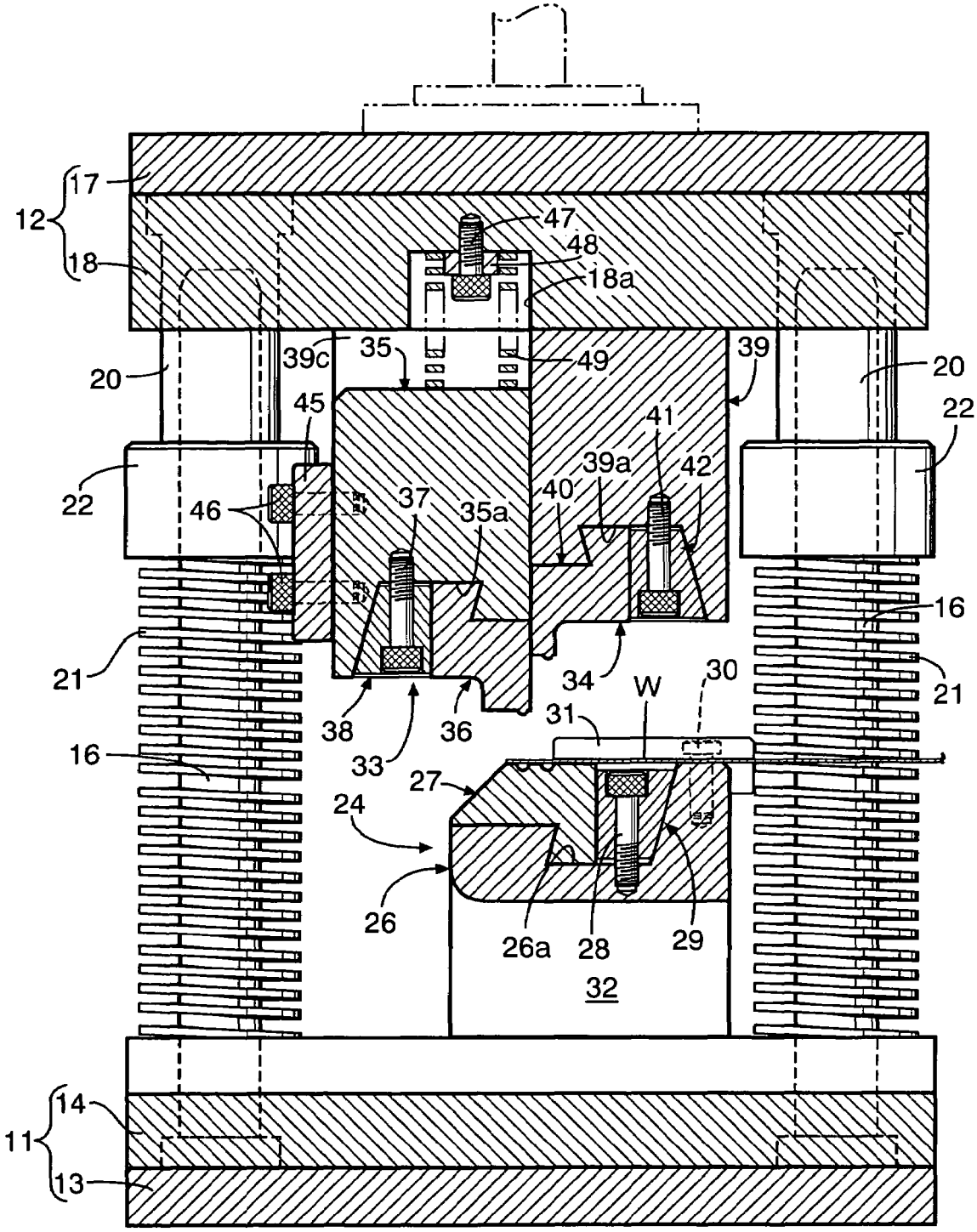

A lower die 24 positioned by knock pins 23, 23 are fixed to the upper surface of the lower plate inner 14 by bolts 25. The lower die 24 includes a pressing-tooth holder 26, a pressing tooth supported in a recess 26*a* in the pressing-tooth holder 26, a wedge member 29 supported in the recess 26*a* and fixed by bolts 28, 28, and work guides 31, 31 fixed to an upper surface of the pressing-tooth holder 26 by bolts 30, 30. A work W as a material is a band-shaped metal plate having a thickness of about 0.1 mm, and is fed intermittently one pitch P by one pitch P (see FIG. 8) from the right side to the left side in FIG. 1 by an automatic supply device (not shown) such as a roller, while its laterally opposite side edges are guided on the work guides 31, 31. As best shown in FIGS. 2 and 5, a cavity 32 is defined in the pressing-tooth holder 26 to extend through the latter in a direction of supply of the work W.

A first upper die punch 33 and a second upper die punch 34 for pressing the work W by cooperation with the lower die 24 are mounted on a lower surface of the upper plate 12. The first upper die punch 33 includes a pressing-tooth holder 35, a pressing tooth 36 supported in a recess 35*a* in the pressing-tooth holder 35, and a wedge member 38 supported in the recess 35*a* and fixed by bolts 37, 37. The second upper die punch 34 includes a pressing-tooth holder 39, a pressing tooth 40 supported in a recess 39*a* in the pressing-tooth holder 39, and a wedge member 42 supported in the recess 39*a* and fixed by bolts 41, 41.

Flanges 39*b*, 39*b* (see FIG. 2) formed on an upper surface of the pressing-tooth holder 39 of the second upper die punch 34 are positioned on a lower surface of the upper plate inner 18 by knock pins 43, 43 and fixed by bolts 44, 44. The pressing-tooth holder 39 of the second upper die punch 34 includes a pair of left and right guide walls 39*c*, 39*c* (see FIG. 4) toward the first upper die punch 33, and a guide plate 45 is fixed to tip ends of the guide walls 39*c*, 39*c* by bolts 46. The pressing-tooth holder 35 of the first upper die punch 33 is capable of being lifted and lowered relative to the second upper die punch 34, while being guided on a body of the pressing-tooth holder 39 of the second upper die punch 34, the pair of left and right guide walls 39*c*, 39*c* of the pressing-tooth holder 39 and the guide plate 45.

Spring seats 48, 48 are fixed in a recess 18*a* formed in the lower surface of the upper plate inner 18 by bolts 47, 47, and the first upper die punch 33 is biased downwards by the abutment of lower end of springs 49, 49 supported at upper ends on the spring seats 48, 48 against an upper surface of the pressing-tooth holder 35 of the first upper die punch 33. At this time, a lower limit position for the first upper die punch 33 is defined by the abutment of the flanges 35*b*, 35*b* provided on the upper surface of the pressing-tooth holder 35 of the first upper die punch 33 against steps 39*d*, 39*d* (see FIG. 2) on upper surfaces of the guide walls 39*c*, 39*c*.

Figure 9:
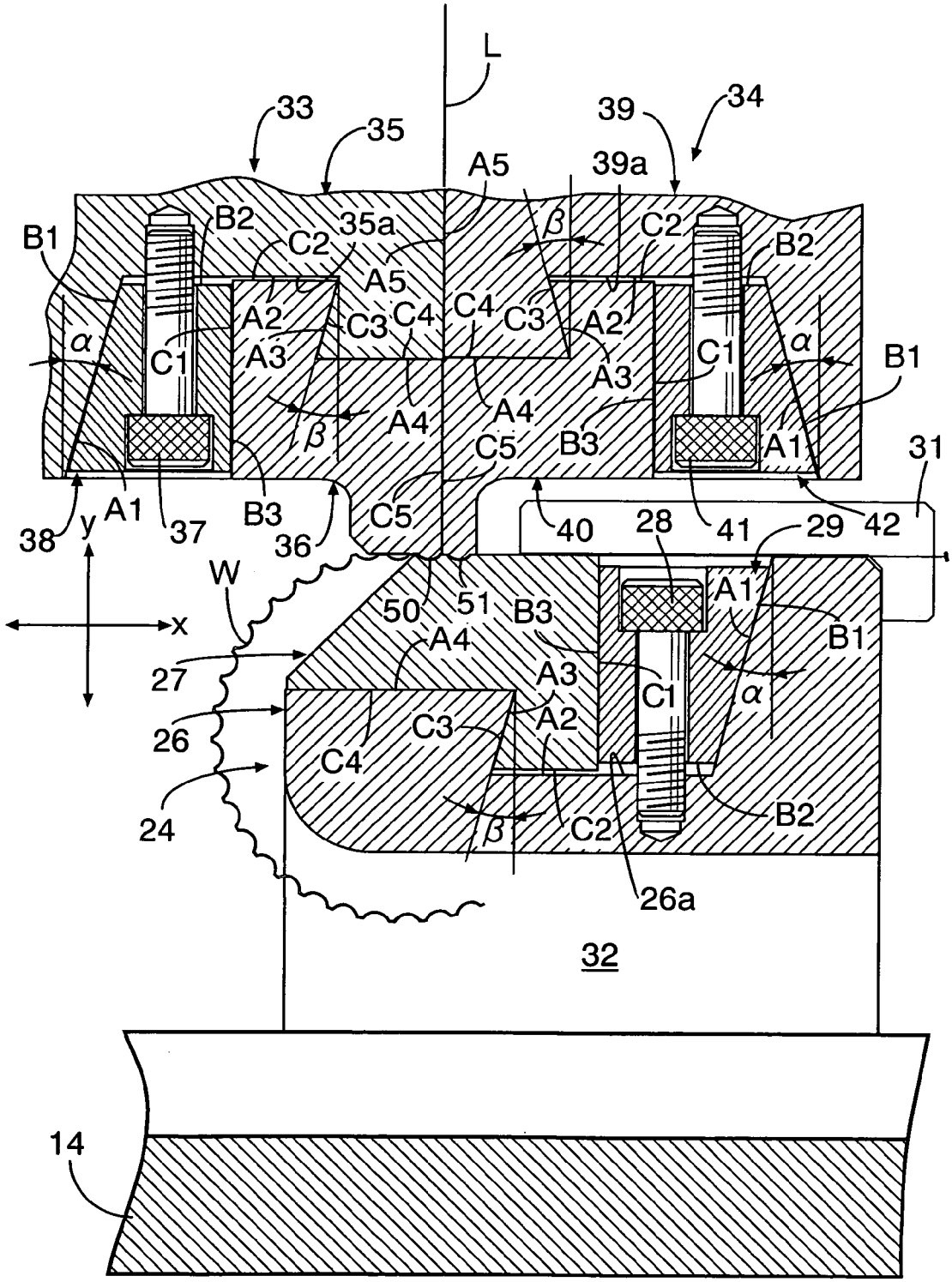

In FIG. 9, a direction of supplying of the work W (a lateral direction in FIG. 9) is defined as a direction of an x-axis, and a pressing direction in which the upper plate 12 is lifted and lowered (a vertical direction in FIG. 9) is defined as a y-axis. The recess 26*a* in the pressing-tooth holder 26 of the lower die 24 has a first inner wall surface A1, a bottom wall surface A2, a second inner wall surface A3 and a bottom wall surface A4. The bottom wall surface A2 and the bottom wall surface A4 are parallel to the x-axis, and the first inner wall surface A1 and the second inner wall surface A3 form acute angles $\alpha$ and $\beta$ with respect to the y-axis, respectively. In the embodiment, $\alpha=\beta=15°$. The wedge member 29 has a first inclined surface B1, an outer wall surface B2 and a parting surface B3. The pressing tooth 27 has a parting face C1, a first outer wall surface C2, a second inclined surface C3 and a second outer wall surface C4. The parting face B3 of the wedge member 29 parallel to the y-axis and the parting face C1 of the pressing tooth 27 slidably abut against each other; the first inclined surface B1 of the wedge member 29 slidably abuts against the first inner wall surface A1 of the recess 26*a*; the second inclined surface C3 of the pressing tooth 27 slidably abuts against the second inner wall surface A3 of the recess 26*a*; and the second outer wall surface C4 of the pressing tooth 27 abuts against the bottom wall surface A4 of the recess 26*a*. Small clearances are formed between the first outer wall surface C2 of the pressing tooth 40 and the bottom wall surface A2 of the recess 26*a* and between the outer wall surface B2 of the wedge member 29 and the bottom wall surface A2 of the recess 26*a*, and a small clearance is also formed between each of the bolts 28, 28 and each of bolt bores in the wedge member 29.

A structure for fixing the pressing tooth 36 and the wedge member 38 in the recess 35*a* in the pressing-tooth holder 35 of the first upper die punch 33 and a structure for fixing the pressing tooth 40 and the wedge member 42 in the recess 39*a* in the pressing-tooth holder 39 of the second upper die punch 34 are the same as a structure for fixing the pressing tooth 27 and the wedge member 29 to the lower die 24. In FIG. 9, surfaces of the recess 35*a* of the pressing-tooth holder 35, the pressing tooth 36 and the wedge member 38 of the first upper die punch 33 and surfaces of the recess 39*a* in the pressing-tooth holder 39, the pressing tooth 40 and the wedge member 42 of the second upper die punch 34 are designated by the same symbols A1 to A4, B1 to B3 and C1 to C4 as the symbols affixed to the surfaces of the recess 26*a* of the pressing-tooth holder 26, the pressing tooth 27 and the wedge member 29 of the lower die 24. The acute angles $\alpha$ and $\beta$ are the same for all of the lower die 24, the first upper die punch 33 and the second upper die punch 34. In the present embodiment, the same member having an interchangeability is used for the three wedge members 29, 38 and 42.

Figure 8:
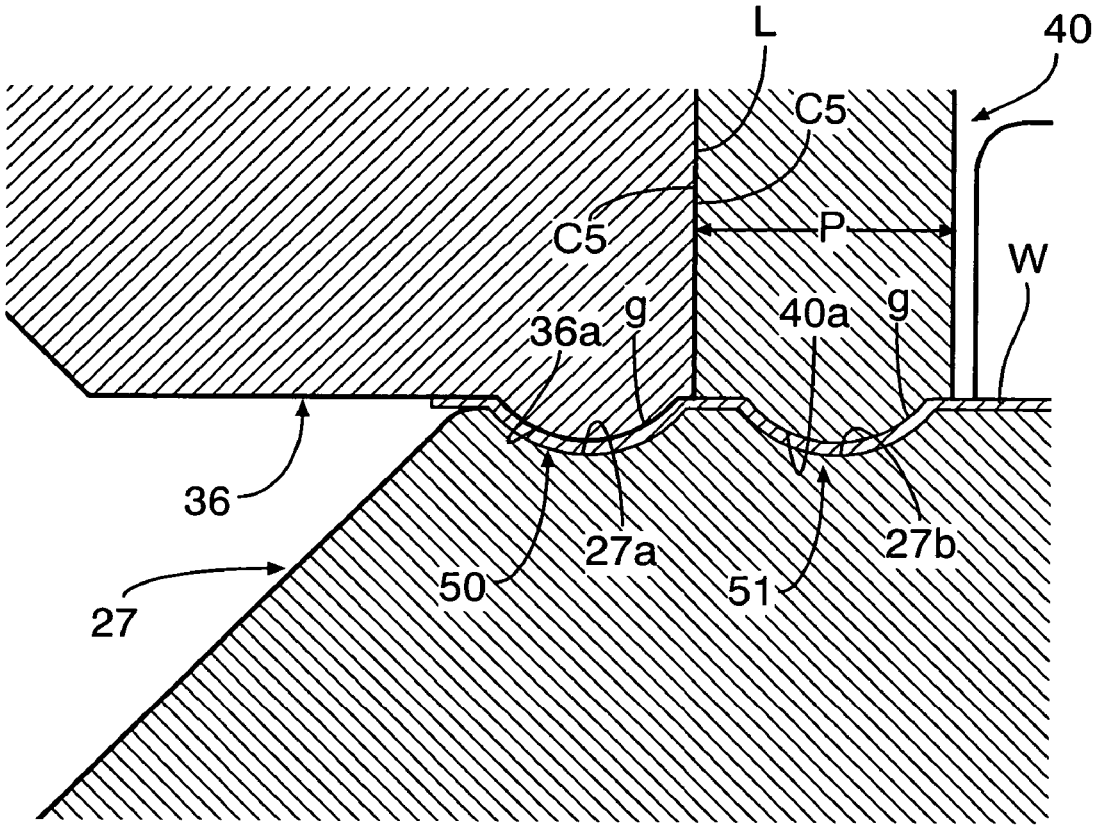

On a working standard line L, a sliding surface A5 of the pressing-tooth holder 35 of the first upper die punch 33 and a sliding surface A5 of the pressing-tooth holder 39 of the second upper die punch 34 slidably abut against each other, and sliding surfaces C5, C5 of the pressing teeth 36 and 40 slidably abut against each other. As shown in FIG. 8, a first recess 27*a* is formed in the pressing tooth 27 of the lower die 24, and a first projection 36*a* is formed on the pressing tooth 36 of the first upper die punch 33 to cooperate with the first recess 27*a*, at locations downstream from the working standard line L in the direction of supplying of the work W, and a second recess 27*b* is formed in the pressing tooth 27 of the lower die 24, and a second projection 40*a* is formed on the pressing tooth 40 of the second upper die punch 34 to cooperate with the second recess 27*b*, at locations upstream from the working standard line L in the direction of supplying of the work W. A positioning portion 50 is formed by the first recess 27*a* and the first projection 36*a*, and a pressing portion 51 is formed by the second recess 27*b* and the second projection 40*a*.

The operation of the embodiment of the present invention having the above-described arrangement will be described below mainly with reference to FIGS. 5 to 8.

Figure 6:
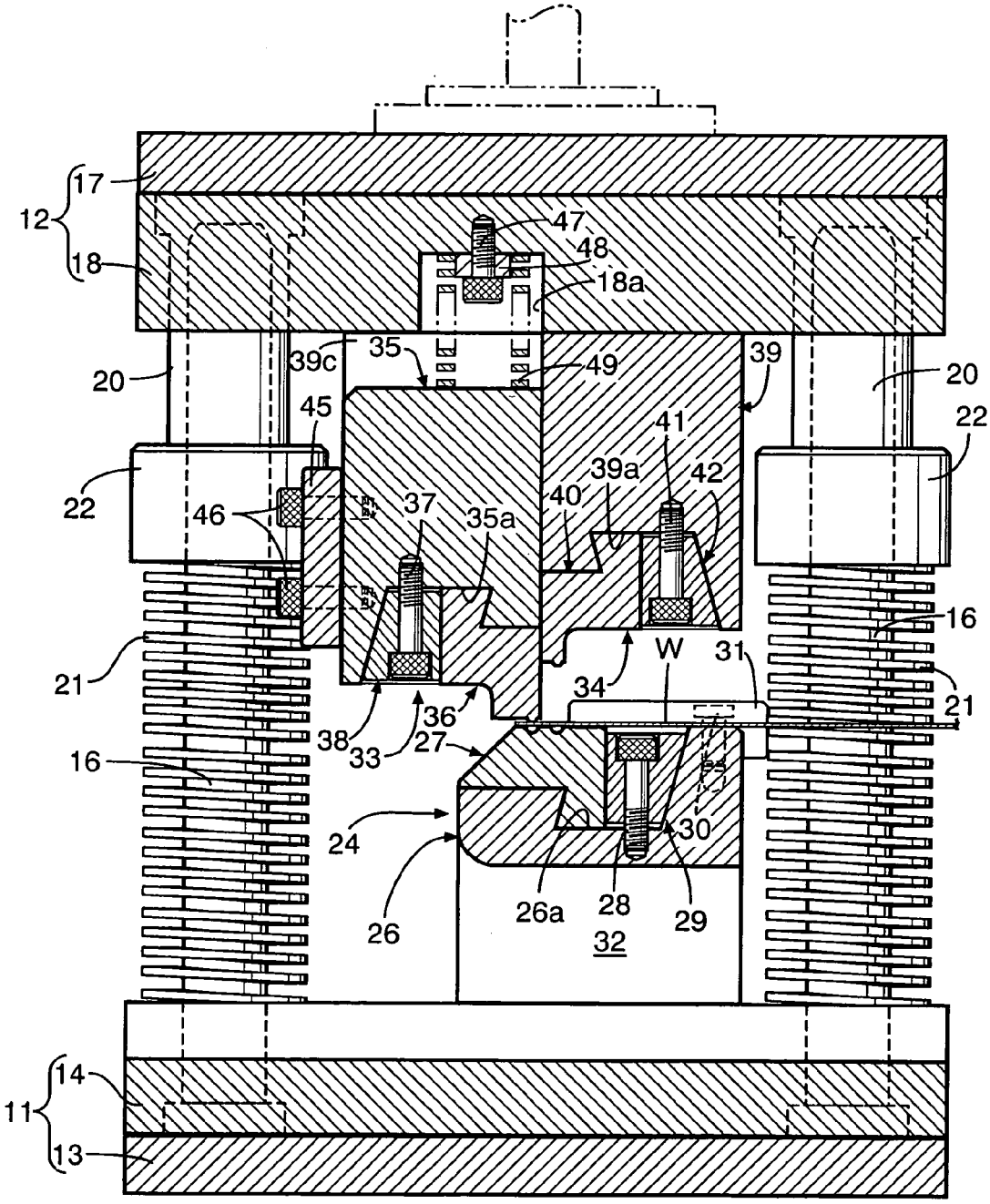

A work W as a material is supplied from a right side in FIG. 5 and stopped in a position in which a tip end of the work W is overlapped on an upper surface of the lower die 24. When the ram (not shown) is driven from this state to lower the upper plate 12, the first upper die punch 33 and the second upper die punch 34 are started to be lowered in unison with each other. The first upper die punch 33 is at a location lower in level than the second upper die punch 34 and hence, the first projection 36*a* of the pressing tooth 36 of the first upper die punch 33 is first put into abutment against the work W, as shown in FIG. 6, thereby pressing the work by cooperation with the first recess 27*a* in the pressing tooth 27 of the lower die 24 to form a groove g (see FIG. 8). At this time, the first upper die punch 33 is lowered, while compressing the springs 49, 49, thereby retaining the work W with a load of 50 kg which is a resilient force of the springs 49, 49. The above-described step is a first step in the present invention, but at only the first step carried out for the first time after the start of the working, the positioning portion 50 comprising the first projection 36*a* and the first recess 27*a*, as described above, presses the work W. At the first step carried out for the second time or thereafter , the positioning portion 50 retains the groove g formed by the pressing at a second step which will be described hereinafter, and at the subsequent second step, the positioning portion 50 presses the work W.

Figure 7:
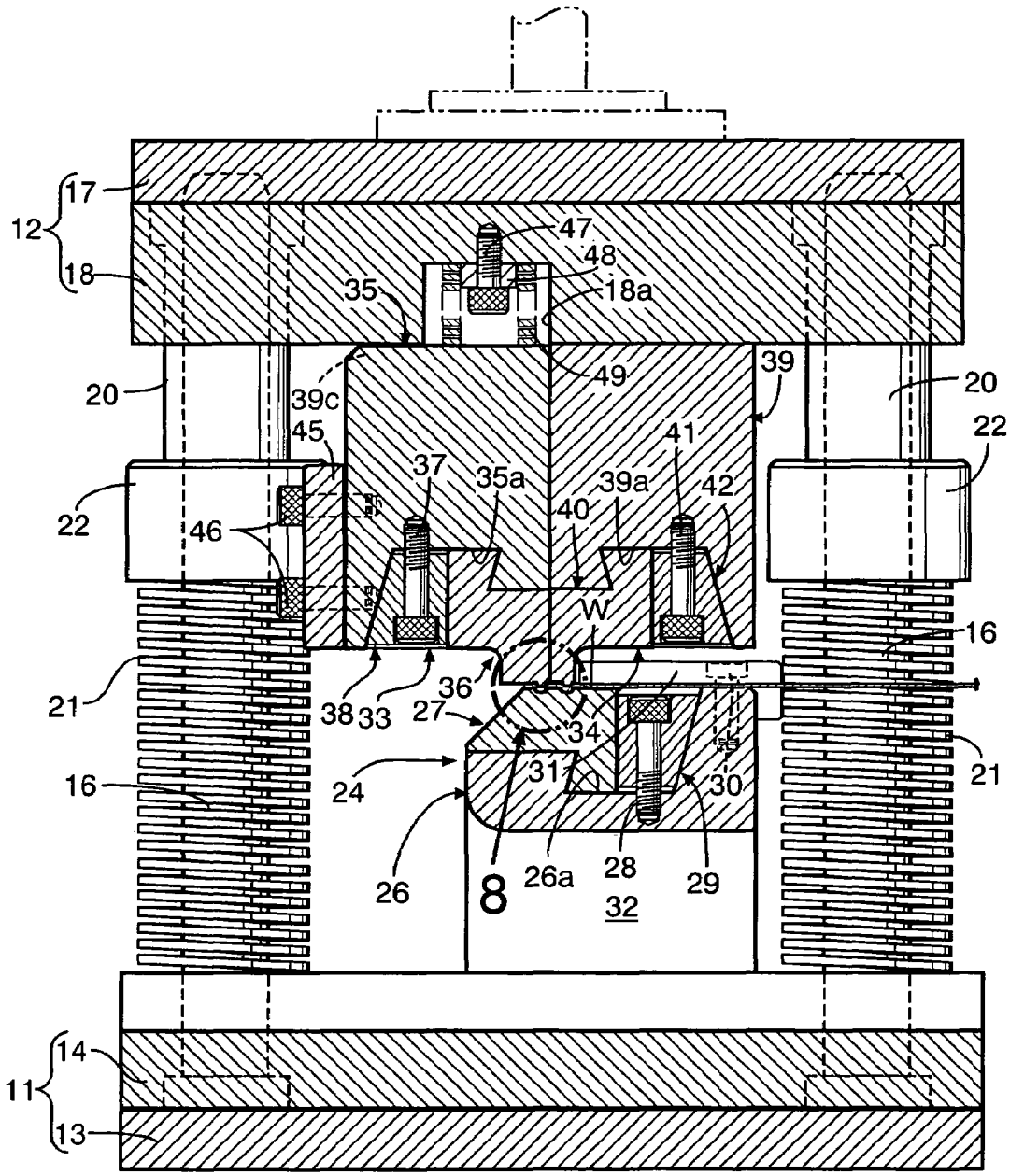

When the ram is driven to further lower the upper plate 12, the second upper die punch 34 is lowered relative to the first upper die punch 33 whose lowering movement has been restrained by the lower die 24, and as shown in FIG. 7, the pressing portion 51 formed by the second projection 40*a* of the pressing tooth 40 of the second upper die punch 34 and the second recess 27*b* of the pressing tooth 27 of the lower die 24 and the positioning portion 50 formed by the second projection 36*a* of the pressing tooth 36 of the first upper die punch 33 and the first recess 27*a* of the pressing tooth 27 of the lower die 24 press the work W with a pressing load of 1 ton to form a groove g. In this case, the work W is pressed, while being retained and positioned non-movably by the positioning portion 50 and hence, the pressing portion 51 can form the groove g precisely on the basis of the working standard line L by pressing. Thereafter, the ram is driven to lift the upper plate 12 to the original position, thus finishing the second step.

At a subsequent third step, the work W is supplied by one pitch P shown in FIG. 8, whereby the groove g formed by the pressing portion 51 is moved to the positioning portion 50. When the processing is returned to the first step in this state and the upper pate 12 is lowered, the positioning portion 50 first retains and positions the groove g already formed at the second step. At the subsequent second step, the pressing portion 51 and the positioning portion 50 press the work W to form a new groove g and the groove g formed at the last second step in the work W, respectively. Thus, it is possible to form the grooves g continuously at every pitch P in the work W by repeating the first to third steps to form a corrugated product. As described above, when a groove g is formed in the work W by pressing the work W by the pressing portion 51, such groove g is formed, while the downstream groove g is retained and positioned by the positioning portion 50. Moreover, the pressing at the pressing portion 51 is carried out every time under the same conditions, and a strain due to the spring-back of the groove g formed in the work W by the pressing portion 51 can be eliminated. Therefore, a product of a high dimensional accuracy having constant pitches P can be produced.

Only the first groove g formed by the positioning portion 50 at the first step carried out for the first time after the start of the working is formed by a procedure different from that for the groove g formed at the first step carried out for the second time and thereafter (not via the second step carried out by the pressing portion 51). Therefore, there is possibility that such first groove g might have a dimensional accuracy different from that of the groove g formed at the first step carried out for the second time or thereafter, but if this first groove g is not used in a product, there is particularly no hindrance.

As shown in FIG. 9, a corrugated plate-shaped product delivered from the positioning portion 50 is of such a shape that it is curved downwards in an arcuate shape due to the influence of the pressing and the influence of the force of gravity, but the curved product can be prevented from being deformed by the interference with the other member by allowing the product to enter into the cavity 32 formed in the lower die 24.

The mounting and demounting of the pressing tooth 27 of the lower die 24, the pressing tooth 36 of the first upper die punch 33 and the pressing tooth 40 of the second upper die punch 34 can be carried out simply in the same procedure. The mounting and demounting of the pressing tooth 40 of the second upper die punch 34 as an example will be described with reference to FIG. 9. When the wedge member 42 has been fastened tightly upwards to the pressing-tooth holder 39 by the bolts 41, 41, the first inclined surface B1 of the wedge member 42 is biased toward the pressing tooth 40 by a leftward load received from the first inner wall surface A1 of the recess 39*a* of the pressing-tooth holder 39, because the small clearance exists between each of the bolts 41, 41 and each of the bolt bores in the wedge member 42.

Then, the second inclined surface C3 of the pressing tooth 40 is pushed against the second inner wall surface A3 of the pressing-tooth holder 39 by the load transmitted thereto through the parting faces C1 and B3. Therefore, the pressing tooth 40 is biased upwards by a reaction force, whereby the second outer wall surface C4 of the pressing tooth 40 is pushed against the bottom wall surface A4 of the pressing-tooth holder 39 and thus fixed firmly, and the small clearance is formed between the first outer wall surface C2 and the bottom wall surface A2. At this time, the small clearance is formed between the outer wall surface B2 of the wedge member 42 and the bottom wall surface A2 of the pressing-tooth holder 39, so that the upward movement of the wedge member 42 is not obstructed. The pressing portion 51 is disposed in an area where it is fixed firmly by the second outer wall surface C4 of the pressing tooth 40 and the bottom wall surface A4 of the pressing-tooth holder 39 and hence, the forming load can be transmitted reliably to the work W, leading to an enhancement in forming accuracy of the groove g.

To demount the pressing tooth 40, the bolts 41, 41 may be loosened to lower the wedge member 42 slightly. The wedge member 42 is moved rightwards by the lowering thereof with the first inclined surface B1 guided on the first inner wall surface A1. Therefore, the pressing tooth 40 can be moved rightwards, whereby the surface pressure between the second inclined surface C3 and the second inner wall surface A3 is lost and thus, it is possible to withdraw the pressing tooth 40 in a direction perpendicular to the surface of the sheet of FIG. 9. In this manner, the mounting and demounting of the pressing tooth 40 are conducted using the wedge member 42. Therefore, it is possible not only to fix the pressing tooth 40 firmly on the recess 39*a* in the pressing-tooth holder 39, while enabling the demounting the pressing tooth 40 by the simple operation, but also to fix the pressing tooth 40 with a repeatability such that it assumes the same position upon every mounting thereof. Moreover, the wedge member 42 and the pressing tooth 40 are brought into close contact with the recess 39*a* in the pressing-tooth holder 39 and hence, not only the rigidity of the second upper die punch 34 is enhanced, but also the position of the pressing tooth 40 is determined constant, leading to an enhancement in working accuracy.

The functions of the inclination angle α of the first inclined surface B1 of each of the wedge members 29, 38 and 42 and the inclination angle β of the second inclined surface C3 of each of the pressing teeth 27, 36 and 40 will be considered with the second upper die punch 34 taken as an example. The meanings of the symbols used in FIG. 10 are as follows:

F1: a load with which the bolts 41, 41 bias the wedge member 42 upwards Fx: a component, in a direction of the x-axis (in a lateral direction in FIG. 10), of a reaction force received from the first inner wall surface A1 by the first inclined surface B1 due to the load F1

Fy: a component, in a direction of the y-axis (in a vertical direction in FIG. 10), of a reaction force received from the second inner wall surface A3 by the second inclined surface C3 due to the load Fx fx: a load in the direction of the x-axis (in the lateral direction in FIG. 10) received from the work W and the lower die 24 by the second projection 40*a* of the pressing tooth 40

Fp: a pressing load for driving the second upper die punch 34 downwards

μ: a maximum coefficient of static friction between the bottom wall surface A4 and the second outer wall surface C4

To maintain the working accuracy when the second upper die punch 34 is lowered to form the groove g in the work W by pressing the work W by the pressing portion 51 in the second step, it is necessary to retain the slide surface C5 of the pressing tooth 40 of the second upper die punch 34 in close contact with the slide surface C5 of the pressing tooth 36 of the first upper die punch 33. At this time, the first upper die punch 33 which is already in engagement with the lower die 24 is restrained in the lateral direction, but the pressing tooth 40 of the second upper die punch 34 forming the groove g in the work W by the pressing process, while being lowered, receives the load fx in the rightward direction (in the direction away from the first upper die punch 33) from the work W and the lower die 24. On the other hand, the pressing tooth 40 of the second upper die punch 34 receives the load μ(Fp+Fy)+Fx in a leftward direction (a direction toward the first upper die punch 33) due to the load F1 provided by the bolts 41, 41 and the pressing load Fp. If the load μ(Fp+Fy)+Fx in the leftward direction is larger than the rightward load fx, namely, an expression, $$fx<\mu(Fp+Fy)+Fx$$

is established, the slide surface C5 of the pressing tooth 40 of the second upper die punch 34 can be retained in close contact with the slide surface C5 of the pressing tooth 36 of the first upper die punch 33.

Fx as a second term of a right side of the above-described expression is a leftward component of a reaction force received from the first inner wall surface A1 by the inclined surface B1 due to the load F1, and is larger as the inclination angle α is smaller. μ(Fp+Fy) as a first term of the right side of the above-described expression is a leftward frictional force received from the pressing-tooth holder 39 by the pressing tooth 40, wherein Fp which is the pressing load assumes a given value, and Fy which is an upward component of the reaction force received from the second inner wall surface A3 by the second inclined surface C3 due to the load F1 is larger as the inclination angle β is larger. Therefore, the slide surface C5 of the pressing tooth 40 of the second upper die punch 34 can be retained in close contact with the slide surface C5 of the pressing tooth 36 of the first upper die punch 33 by setting the two inclination angles α and β to satisfy the above-described equation.

If a complementary angle of α is defined as α'(=90−α), and a complementary angle of β is defined as β'(=90−β), an equation Fx=F1×tan α' is established, and the larger the complementary angle α', namely, the smaller the inclination angle α, the larger the load Fx. When the load Fx is larger, the load Fy is also larger and hence, the leftward load μ(Fp+Fy)+Fx opposing the rightward load fx is also larger, which is preferable. On the other hand, there is a problem that even if the wedge member 42 is loosened, the pressing tooth 40 is difficult to be withdrawn from the pressing-tooth holder 39. Therefore, in the present embodiment, the inclination angle α is set at 15°, and the inclination angle β is likewise set at 15° from the viewpoint of the easiness of manufacture and the working accuracy.

Figure 11A:
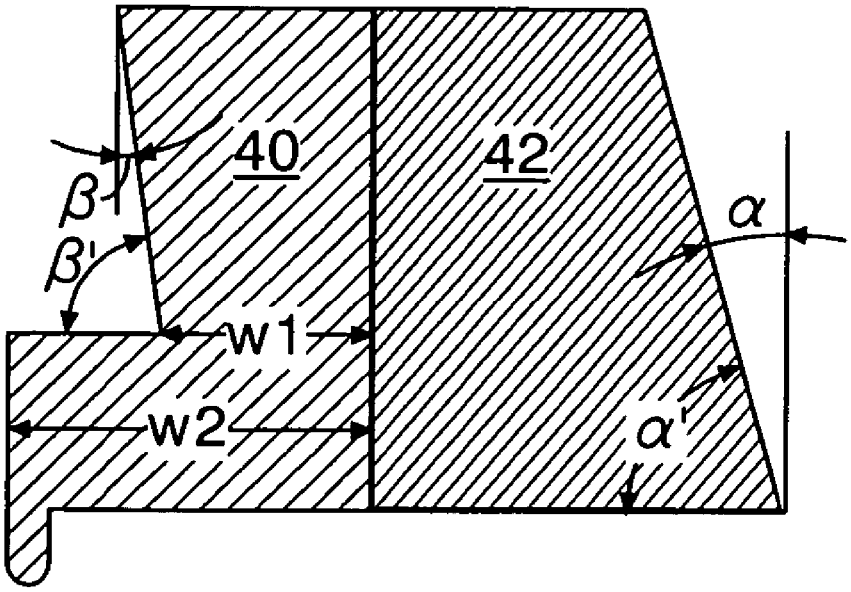
FIG. 11A is a view showing a second embodiment in which inclination angles α and β are different from each other.

Now, the load Fy in the direction of the Y-axis is given according to Fy=F1×(tan α'/tan β'), and if α'=β' as in the present embodiment, Fx=Fy. On the contrast, if α' and β' are set so that α'≦β'(namely, α≦α'), as shown in FIG. 11A which is a second embodiment, Fy≦Fx, namely, Fy is decreased, and the leftward load μ(Fp+Fy)+Fx opposing the rightward load fx is decreased. However, there is an advantage that the entire width w2 of the pressing tooth 40 for ensuring a minimum width w1 required for the strength of the pressing tooth 40 can be decreased. From the forgoing, the specification of α≧β is preferred when the rightward load fx intended to move the pressing tooth 40 away from the pressing tooth 36 is smaller.

Figure 11B:
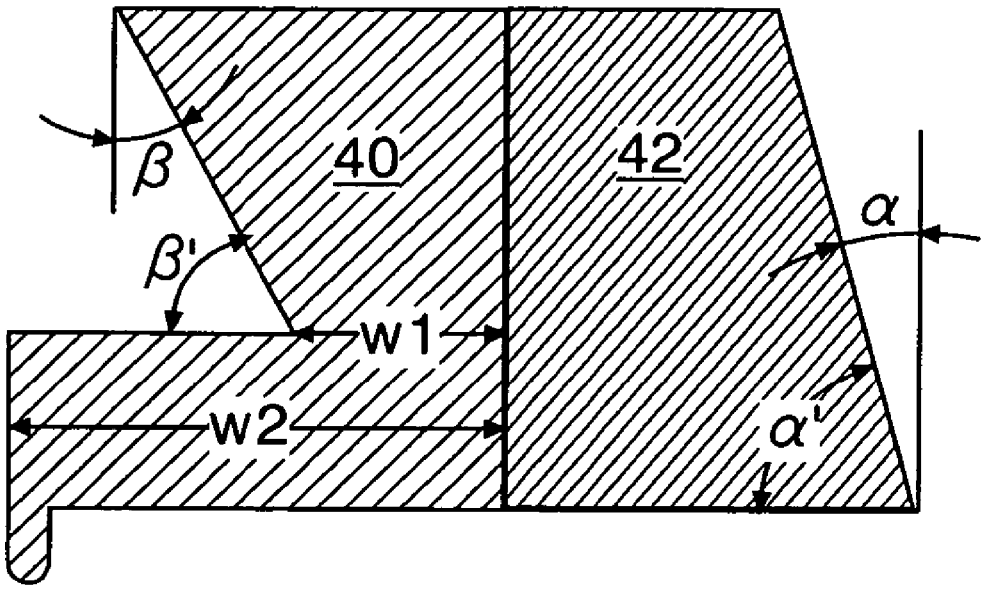
FIG. 11B is a view showing a third embodiment in which inclination angles α and β are different from each other.

If α' and β' are set so that α'>β'(namely, α<β), as shown in FIG. 11B which is a third embodiment, Fy>Fx, wherein Fy is increased, and the leftward load μ(Fp+Fy)+Fx opposing the rightward load fx can be increased. However, such a disadvantage occurs that the entire width w2 of the pressing tooth 40 for ensuring the minimum width w1 required for the strength of the pressing tooth 40 is increased. From the forgoing, the specification of α<β is preferred when the rightward load fx intended to move the pressing tooth 40 away from the pressing tooth 36 is larger.

Figure 12:
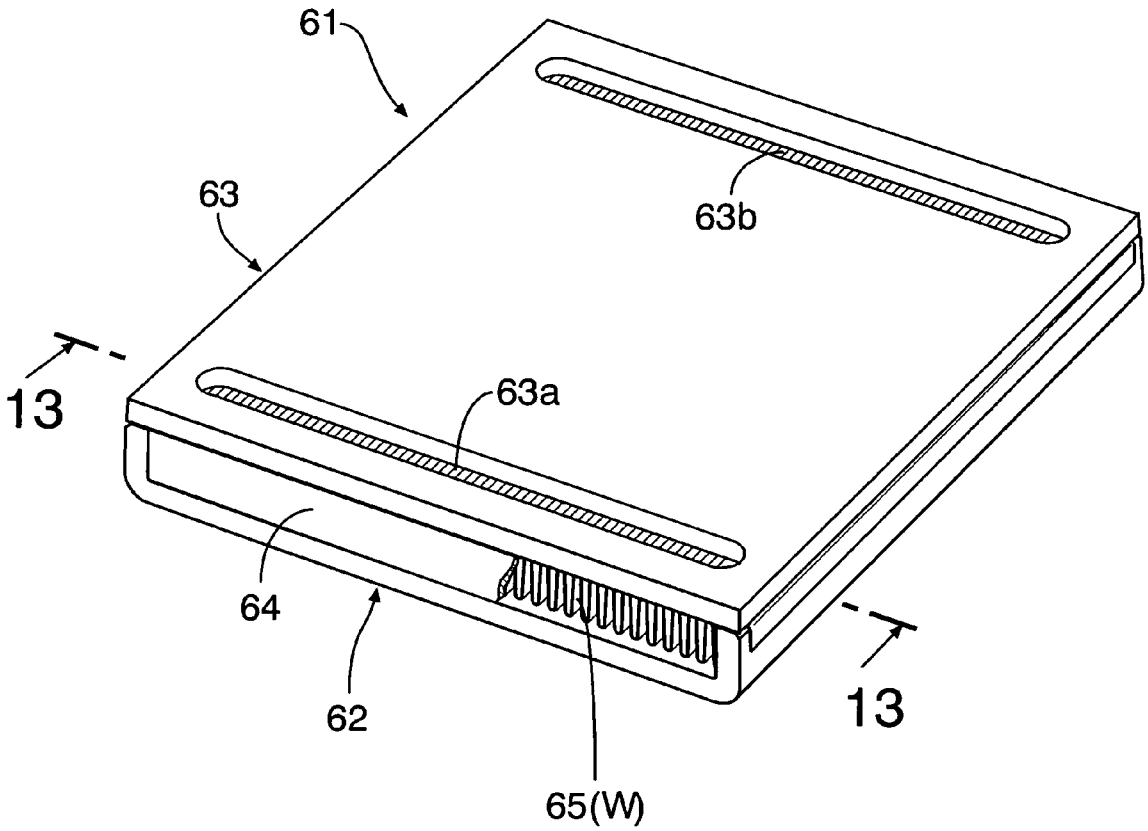
Figure 13:
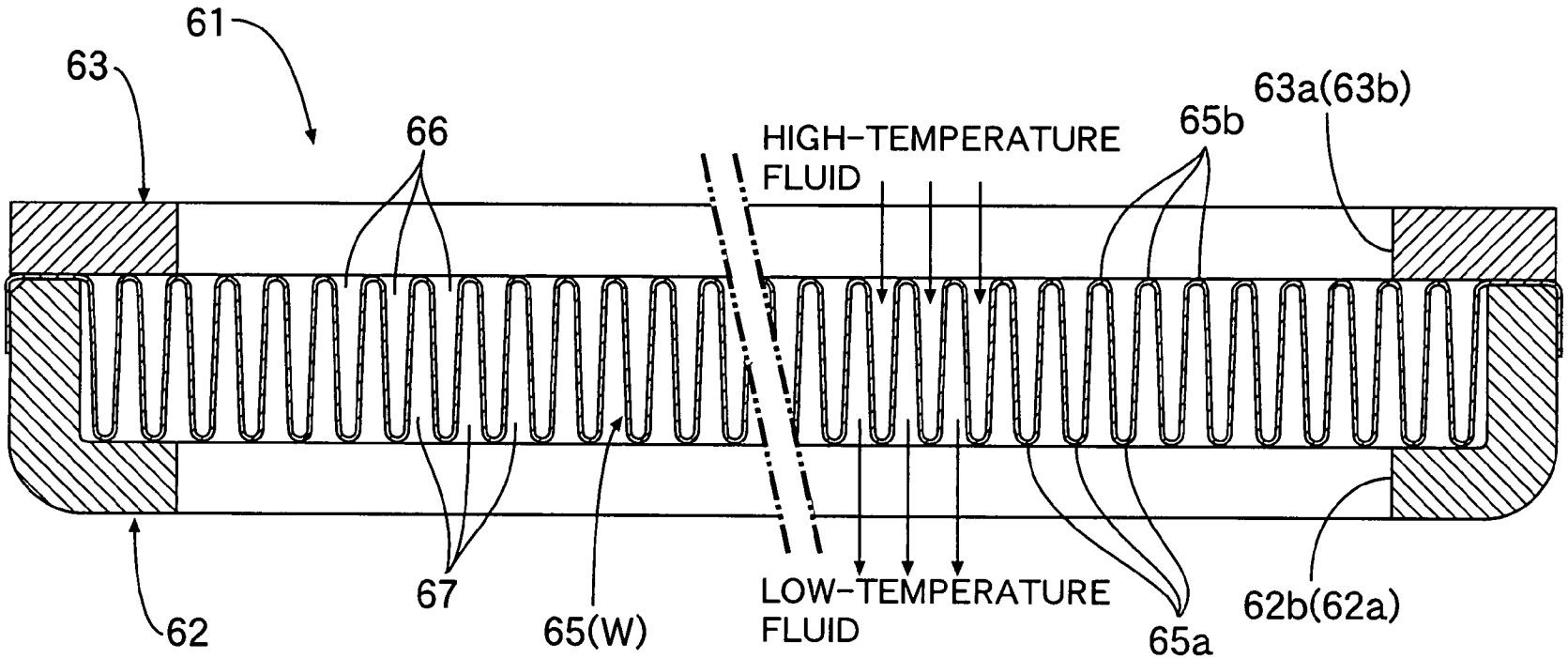

A fourth embodiment of the present invention will be described with reference to FIGS. 12 and 13.

The pressing apparatus according to the first embodiment is used to form the corrugated plate used as the foil of the foil-type fluid bearing from the band-shaped material by the pressing process and can be utilized to the formation of a heat transfer plate curved in a corrugated shape for a heat exchanger by a pressing process. The structure of a heat exchanger including a heat transfer plate curved in a corrugated shape will be described below.

A heat exchanger 61 is formed into a substantially rectangular parallelepiped shape and includes a body casing 62 of a U-shape in section, a cover plate 63 covering an opening in an upper surface of the body casing 62, and a pair of end plates 64, 64 covering openings in opposite ends of the body casing 62. A heat transfer plate 65 formed from a band-shaped metal plate as a work W by the pressing apparatus described in the first embodiment is accommodated in the heat exchanger 61. Opposite sides of the heat transfer plate 65 is fixed in such a manner that it is sandwiched between the body casing 62 and the cover plate 63.

The heat transfer plate 65 has a shape comprising valleys 65*a* and crests 65*b* continuously connected together, and high-temperature fluid passages 66 through which a high-temperature fluid flows and low-temperature fluid passages 67 through which a low-temperature fluid flows, are alternately formed with the heat transfer plate 65 interposed therebetween by fixing the valleys 65*a* to an upper surface of the body casing 62 and fixing the crests 65*b* to a lower surface of the cover plate 63.

A high-temperature fluid inlet port 63*a* and a high-temperature fluid outlet port 63*b* each having a long groove-shape are formed at one end and the other end of the cover plate 63 to communicate with the high-temperature fluid passages 66, and a low-temperature fluid inlet port 62*a* and a low-temperature fluid outlet port 62*b* each having a long groove-shape are formed at the other end and one end of the body casing 62 to communicate with the low-temperature fluid passages 67.

Thus, the high-temperature fluid flowing in the high-temperature fluid passages 66 and the low-temperature fluid flowing in the low-temperature fluid passages 67 are heat-exchanged with each other through the heat transfer plate 65. At this time, the high-temperature fluid and the low-temperature fluid are in so-called counter flow states in which they are flowing in opposite directions, because the high-temperature fluid inlet port 63*a* and the low-temperature fluid outlet port 62*b* are provided at locations corresponding to the surface and back of the heat exchanger 61 and the high-temperature fluid outlet port 63*b* and the low-temperature fluid inlet port 62*a* are provided at locations corresponding to the surface and back of the heat exchanger 61. Thus, it is possible to maintain a difference between the temperatures of the high-temperature fluid and the low-temperature fluid at a large value over the entire regions of the high-temperature fluid passages 66 and the low-temperature fluid passages 67 to enhance the heat exchange efficiency.

In general, as the heat transfer plate 65 is disposed at a higher density within a given space in the heat exchanger 61, the heat exchange efficient is higher. Therefore, the bending radius of each of the valleys 65*a* and the crests 65*b* of the heat transfer plate 65 is decreased, and it is difficult to form the heat transfer plate 65 into a correct corrugated shape due to the influence of the spring-back. If the distances between the valleys 65*a* and the crests 65*b* of the heat transfer plate 65 are irregular, there is a possibility that gaps may be generated in regions where the valleys 65*a* and the crests 65*b* are connected to the body casing 62 and the cover plate 63, whereby the high-temperature fluid and the low-temperature fluid may be mixed together. However, the heat transfer plate 65 formed by the pressing apparatus according to the present invention has an extremely correct size and hence, it is possible to reliably avoid the arising of the above-described disadvantage.

Although the embodiments of the present invention have been described in detail, it will be understood that various modifications in design may be made without departing from the subject matter of the invention defined in claims.

For example, the pressing apparatus for forming the corrugated plate used as the foil of the foil-type fluid bearing and the corrugated plate used as the heat transfer plate of the heat exchanger from the band-shaped material has been illustrated in the embodiments, but the present invention is applicable to a pressing process and a pressing apparatus used in any other application.

INDUSTRIAL APPLICABILITY

As discussed above, the pressing process and the pressing apparatus according to the present invention can be used effectively for forming a corrugated plate in a precise shape from a band-shaped material.

What is claimed is:

1. A pressing apparatus comprising pressing dies that are relatively movable in a pressing direction, each of the pressing dies having (1) a pressing-tooth holder with a recess having a bottom wall surface, (2) a pressing tooth disposed in the recess and (3) a wedge member for fixing the pressing tooth in the recess, and wherein:

in each of the pressing dies, the pressing tooth and the wedge member slidably abut against each other at parting faces parallel to the pressing direction;

each wedge member (1) has a first inclined surface inclined at an acute angle a with respect to the pressing direction, so that the wedge member narrows in a direction toward the bottom wall surface of the recess, and (2) slidably abuts, at the first inclined surface thereof, against a first inner wall surface of the recess;

each pressing tooth (1) has a second inclined surface inclined at an acute angle β with respect to the pressing direction, so that the tooth widens in a direction toward the bottom wall surface of the recess, and (2) slidably abuts, at the second inclined surface, against a second inner wall surface of the recess; and wherein in each of the pressing dies, the wedge member, when subjected to a load F1 in a direction toward the bottom wall surface of the recess, (1) pushes against the pressing tooth with a reaction force Fx in a direction perpendicular to the parting faces, the reaction force Fx resulting from force applied to the first inclined surface of the wedge member by the first inner wall surface of the recess, and (2) produces a reaction force Fy that urges the pressing tooth toward the bottom wall surface of the recess, to fix the pressing tooth in the recess, the reaction force Fy resulting from force applied to the second inclined surface of the pressing tooth by the second inner wall surface of the recess.

2. A pressing apparatus according to claim 1, wherein $\alpha=\beta$.

3. A pressing apparatus according to claim 1, wherein $\alpha \geqq \beta$.

4. A pressing apparatus according to claim 1, wherein $\alpha<\beta$.

5. A pressing apparatus according to claim 1, wherein:

two of the pressing dies slidably abut against each other at slide surfaces parallel to the pressing direction; and the acute angle α and the acute angle β are determined so that an expression, $$fx<\mu(Fp+Fy)+Fx$$

is established among the load F1, the reaction force Fx, the reaction force Fy, a pressing load Fp applied to one of the two pressing dies in the pressing direction, a load fx in the direction perpendicular to the parting faces resulting from force applied to the pressing tooth of the one of the two pressing dies by work restrained by the other of the two pressing dies, and a coefficient $\mu$ of friction between the pressing tooth and the bottom wall surface of the recess of the one of the two pressing dies.

6. A pressing apparatus according to claim 5, wherein $\alpha=\beta$.

7. A pressing apparatus according to claim 5, wherein $\alpha \geqq \beta$.

8. A pressing apparatus according to claim 5, wherein $\alpha<\beta$.

* * * * *